United States Patent [19]

Lamperti

[11] 4,143,826

[45] Mar. 13, 1979

[54] COIL UNWINDER

[76] Inventor: Enrico Lamperti, Via Ercole Ferrario, 4, Gallarate Varese, Italy

[21] Appl. No.: 776,472

[22] Filed: Mar. 10, 1977

[30] Foreign Application Priority Data

Mar. 10, 1976 [IT] Italy ..... 83606 A/76

[51] Int. Cl.[2] ..... B65H 49/20; B65H 57/18

[52] U.S. Cl. ..... 242/54 R; 242/86.5 R; 242/157 R; 280/43.14

[58] Field of Search ..... 242/54 R, 82, 83, 128, 242/129, 86.5 R, 45, 157 R, 76; 280/43.14, 43.24

[56] References Cited

U.S. PATENT DOCUMENTS

| | | | |
|---|---|---|---|
| 2,624,590 | 1/1953 | Tilton | 280/43.14 |
| 2,812,189 | 11/1957 | Geldhof | 280/43.14 |
| 3,002,703 | 10/1961 | Hinchman | 242/180 |
| 3,282,518 | 11/1966 | Holmes | 242/54 R |
| 3,436,031 | 4/1969 | Winders | 242/54 R |
| 3,815,837 | 6/1974 | Guthrie | 242/54 R |

FOREIGN PATENT DOCUMENTS

| | | | |
|---|---|---|---|
| 624303 | 6/1949 | United Kingdom | 280/43.14 |

*Primary Examiner*—George F. Mautz
*Attorney, Agent, or Firm*—Young & Thompson

[57] ABSTRACT

A coil unwinding apparatus is provided and comprises a housing which rotatably supports a plate which carries the coil. A motor is contained within the housing which rotatably drives the plate while guide members secured to the housing guide the thread as it is unwound from the coil. A transport device is contained within the housing which can be manually actuated by a lever to raise the housing on a wheeled platform so that the unwinding apparatus can be moved via the wheeled platform.

4 Claims, 6 Drawing Figures

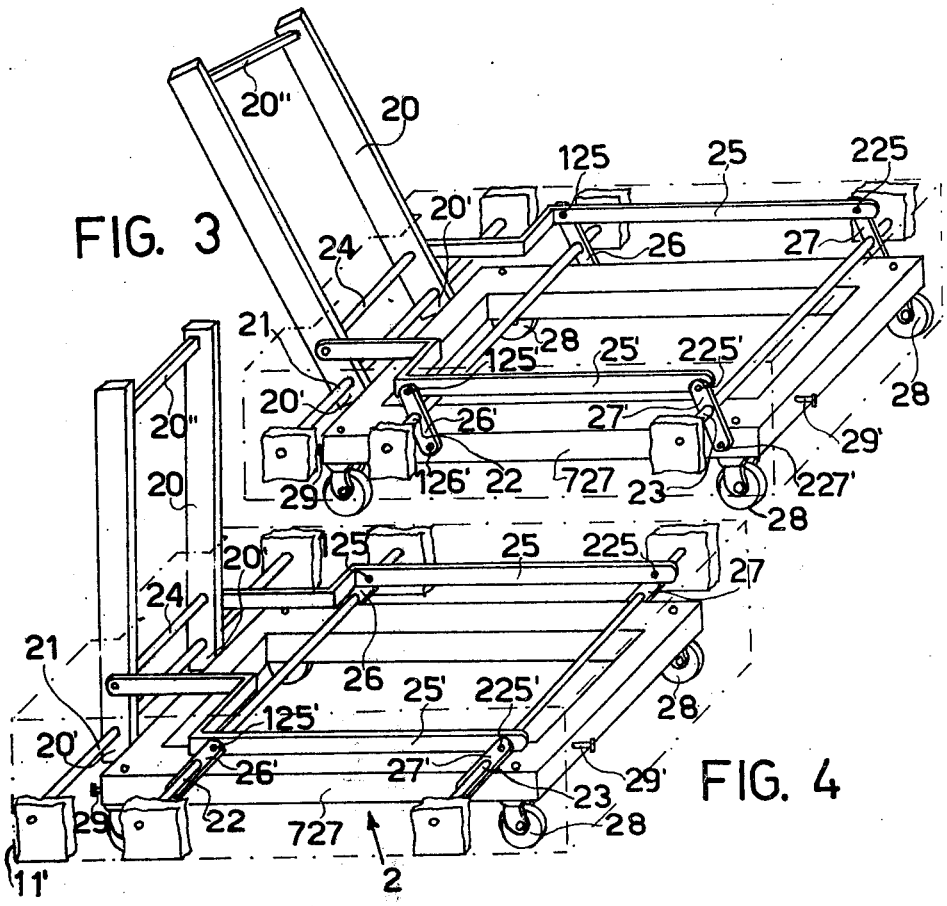
FIG. 3
FIG. 4
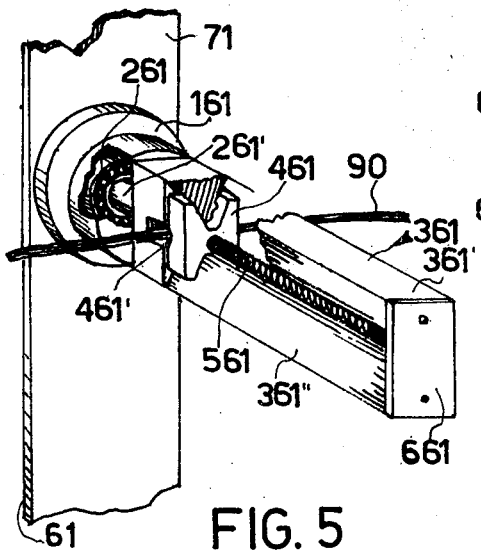
FIG. 5
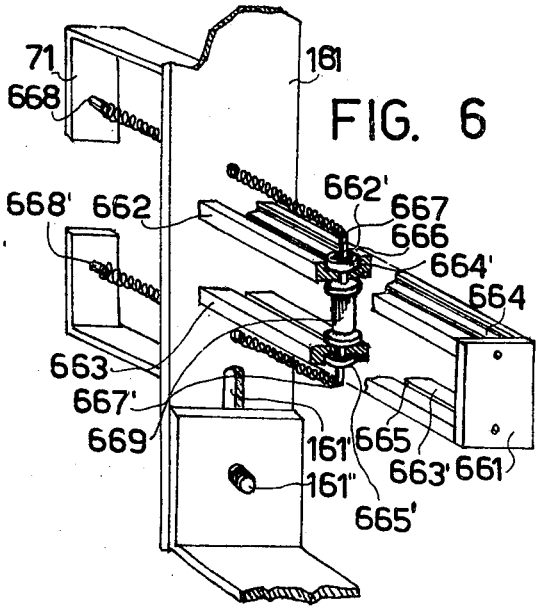
FIG. 6

COIL UNWINDER

I. FIELD OF THE INVENTION

The present invention relates to a reel-unwinder and more particularly to a reel unwinder having tracks and therefore displaceable, and in which a motor is housed inside a load bearing column for the actuation of the reel-unwinder.

II. PRIOR ART

In the present state of the art there already exist self-propelled reel-unwinders, but these typically operate with devices which are substantially fixed and thus operable for a single machine or for a single type of machine. The machines which work with or process threads, wires, strips, ribbons or thin sections are many and of a varied nature, both in the field of machine tools for working metals, and in the field of machines for working plastic materials. In addition for one given machine there can be a variety of different materials with different dimensions of the threads or wires such as to require reel-unwinders with different specific characteristics. Thus the previously known reel-unwinders which are suited for a single specific use suffer obvious disadvantages.

One disadvantage was that the reel-unwinder received the thread material at a relatively high level with respect to its base so that variations in the movement of the thread resulted in stresses in the support members of the reel platform and even direct displacements of the reel base on the floor. To avoid this previously the base was fixed to the ground or else the base was weighted with heavy objects to increase the stability of the unwinder. Moreover, in the previously known reel-unwinding devices, the base was carried directly on a motor-reducer unit and the motor reducer in turn directly carried the platform or plate of the reel. Structures of this type did not perform well in that the motor reducer unit was directly affected by the unbalancing stresses.

The previously known reel-unwinding devices also lacked the conventional mechanisms for straightening the thread so that a conventional thread straightening mechanism was also required for the machine working the thread. This requirement complicated the control of the thread downstream of such straightening mechanisms so that the thread entered the machine in a twisted or bent condition. Moreover, in the prior reel-unwinding devices the suspension members for the final feed coil of the machine which also included the servo-controls for start-up and stoppage of the reel, had disadvantages which inhibited the timely and precise intervention of the reel-unwinding device. Furthermore, the prior reel-unwinding devices, having a static structure, were provided with means for attachment to the conventional network of other static machines.

SUMMARY OF THE PRESENT INVENTION

The aim of the present invention is to eliminate the aforesaid disadvantages and to offer still further advantages.

The reel-unwinding device, in accordance with the present invention, includes improved members or components, which results in a flexible device suited to a very wide range of different uses. This flexibility, combined with the mobility of the reel-unwinder of the present invention permits the reel-unwinder to be used in conjunction with any one of the machines of a plant so that the device enjoys unlimited adaptability and flexibility.

The reel-unwinder achieves increased stability by providing a bearing structure and frame which substantially directly supports all the components of the reel-unwinder. Moreover, the weight and dimensions of the unwinder are such that, resting on the floor, it provides the necessary stability in operation. In order to shift the reel from one place to the other, the present invention includes a handle-bar having the form of a lever and capable of assuming two positions, one of them adjacent and adhering to the frame of the reel and the other jutting or protruding outwardly in the manner of a handle-bar. The handle-bar is of such strength that it is capable of raising the frame and the base from the floor and onto a triad of wheels which transform the reel-unwinder with its handle-bar substantially into a trolley which is displaceable manually.

In accordance with the present invention, the motor reducing unit is firmly fixed to the walls of the frame and, both the transmission member for the movement and the wound thread carrying plate which receives it, are firmly supported by specific supports integral with the frame, so that each member is subjected only to the direct rather than indirect stresses.

In accordance with a preferred embodiment of the present invention, the reel-unwinding device comprises a mechanism for straightening the thread, such as to allow the control of the thread while permitting intervention in order to achieve perfect straightening of the thread.

Still in accordance with the present invention, the suspension members for the final coil of the wound thread to be sent to the feed of the machine have been improved so as to make them more tractable and less subject to wear. In particular the members which support the servo-drives for starting or stoppage of the reel have been mechanically and electrically improved so that they supply not only the signal for the start-up and stoppage of the motor which drives the reel, but also that these signals are proportional to the magnitude of the displacement of the servo control. These signals are coupled to a D.C. motor and produce the timely and gradual adjustment of the position of the wound thread or coil in response to the demand for thread from the user machine thereby substantially minimizing the machine stresses. In accordance with a preferred embodiment of the invention then, the reel-unwinder is provided with a cable-winding device so that it can be used as a movable device for any one or all of the user machines in the plant.

In accordance with a preferred embodiment then, the entire transmission unit situated between the motor and the shaft of the plate which bears the coil of thread, has been improved. More precisely the motor is coupled to the transmission unit by means of a belt so as not to transmit its own vibrations to the transmission. In turn the reducer transmits its own reduced movement to a vertical shaft, via a coupling, and this latter shaft is coupled to the shaft of the coil carrying plate by means of an elastic clutch. The motor shaft is bi-protruding so that one end actuates the transmission members while its other end can be manually actuated by means of a hand-wheel (when the motor is turned off) positioned outside of the machine.

BRIEF DESCRIPTION OF THE DRAWINGS

In order to better understand the characteristics of the present invention, reference is made here to the attached drawings which show a preferred embodiment of the invention in which:

FIG. 3 is a detailed view of the device having the form of a trolley with a handle installed partly inside and partly outside the frame of the reel-unwinder;

FIG. 4 is a view similar to FIG. 3, but with the trolley and the handle in the position suitable for displacement;

FIG. 5 is a detailed perspective view of a modification of the thread guide; and FIG. 6 is a detailed perspective view of a still further modification of the thread guide.

DETAILED DESCRIPTION OF THE PREFERRED EMBODIMENT

Figure 1:
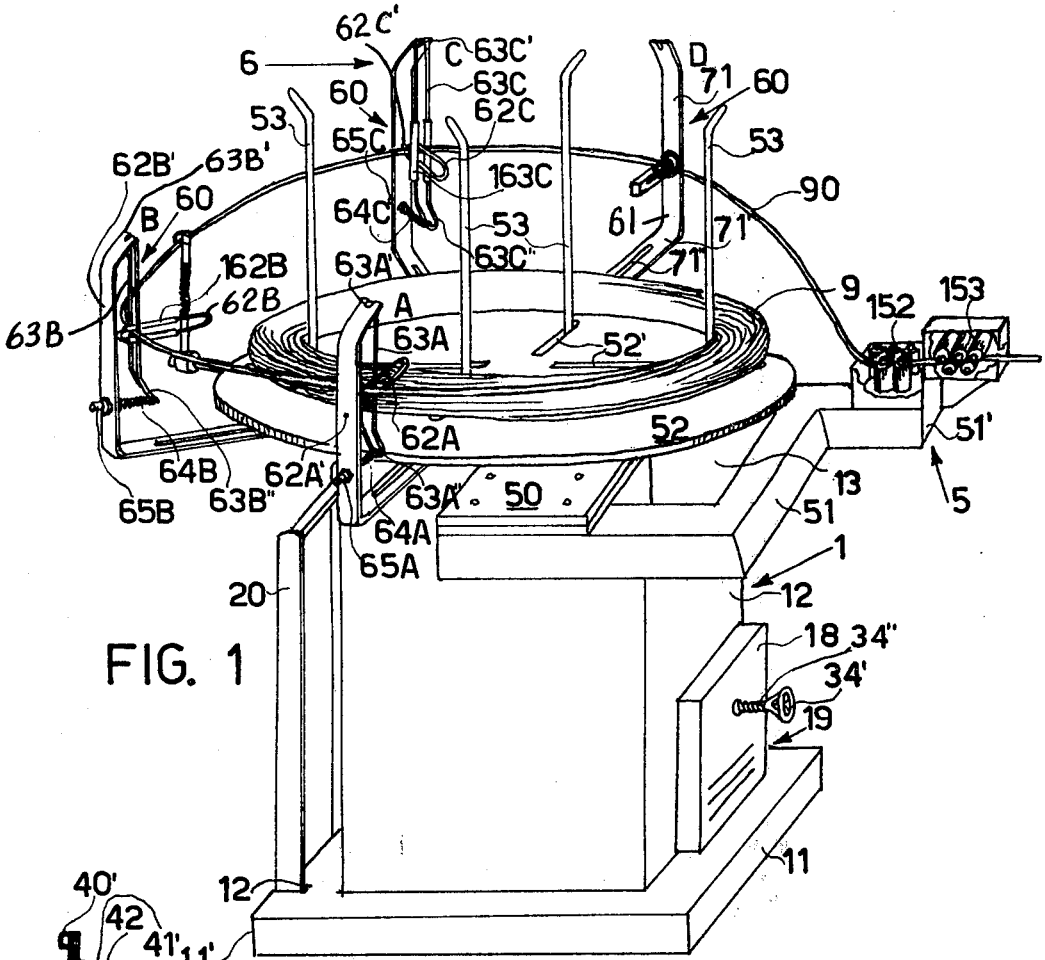
FIG. 1 is a perspective overall view of a reel-unwinder in accordance with the present invention.

With reference to the drawings, a reel-unwinder in accordance with the present invention is shown and comprises bearing frame 1, a means 2 (FIG. 4) for raising and laterally moving the frame 1, a transmission means 3 (FIG. 2), a servo control means 4 (FIG. 2), a thread straightening means 5 (FIG. 1), a suspension or holding means 6 for the unwinding thread and a cable-winding device 7.

More specifically, the frame 1 comprises a box body having a base 11 which is hollow and open on the bottom, a vertical and hollow column 12, and an upper part 13. A plate 50 is secured to the upper level 13 while a Z-shaped support 51 forms a horizontal extension from the plate 50. Attached to the outer end 51' of this support 51 are two conventional systems 152 and 153 of straightening rollers, respectively vertical and horizontal. In the base 11 of the frame 1 there is housed the raising and motion device 2 (FIGS. 3 and 4), handle 20 of which emerges outwardly from the base 11 via two slots 12 formed in the base 11. The device 2 is shown retracted or ineffective in FIG. 4, and extended or effective in FIG. 3. Also in FIG. 1 the handle 20 is shown in the ineffective or retracted position, but in this figure only the handle 20 is visible The pivot pins 21, 22 and 23 (FIGS. 3, 4) emerge from the flank 11' of the base 11. The pin 21 is horizontally fixed in the base 11 and abuts against the ends 20' of the handle 20, which has substantially the shape of an inverted "U", with a handle cross bar 20''.

The handle 20 includes a pair of upwardly extending spaced bars with a pin 24, to which are hinged the ends of two connecting rods 25 and 25' extending transversely across the arms. Each connecting rod 25 and 25' has two hinging pins 125, 225, 125', 225', respectively, which attach to a pair of levers 26 and 27, 26' and 27', respectively, fulcrumed (26 and 26') on the pin 22, and fulcrummed (27, 27') on the pin 23. The levers 26, 26', 27, 27', are centrally fulcrumed respectively on the pins 22 and 23 and at their other ends support a frame 727 via pins 126, 227, respectively. Dolly wheels 28 are attached at the four corners of the frame 727.

As has been said, the device 2, as shown in FIG. 4 is in the position of ineffectiveness with the handle 20 raised, that is to say the handle 20 parallel to the framework 1. By lowering the handle 20, i.e. by moving the handle 20 away from the framework 1, the ends 125 and 125', 225 and 225' of the levers 26, 26', 27, 27', move in the same direction causing a rotation in the counter-clockwise direction (as viewed in FIGS. 3 and 4) of these levers 26, 26', 27, and 27'. More precisely, as is shown in FIGS. 3 and 4, the levers 26, 26', 27, 27' rotate from a position in which they are inclined in one direction (FIG. 4) to a position less inclined in the opposite direction beyond the vertical (FIG. 3). This effects the lowering of the frame 727 and hence the wheels 28 with force, with regard to the base 11 of the frame 1 which force is transmitted via the pins 22 and 23. With the lowering of the wheels 28, the reel-unwinder can be rolled on the wheels 28 into any position and next to any machine in a plant, simply by pulling on the handle 20. The position of the levers 26, 26', 27, 27', in either case is unstable which is nevertheless made stable by the locking screws 29, 29'.

Figure 2:
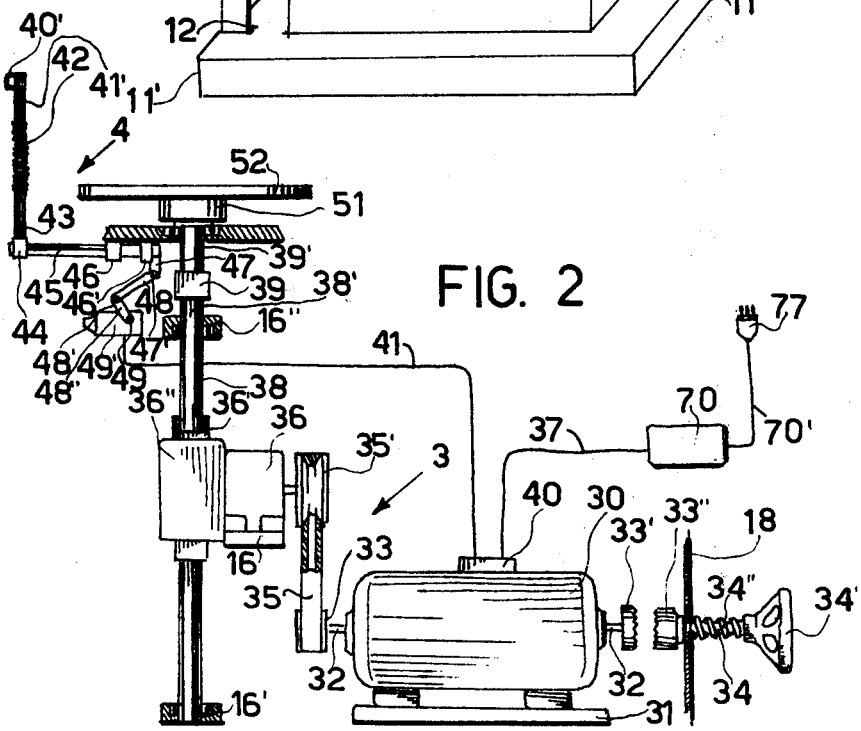
FIG. 2 is a schematic view showing the transmission members of the invention.

Describing now the transmission, with reference to FIG. 2, a motor 30 is housed inside the column 12 of the frame 1 on a plate 31 which is integral with the frame 1 itself. The motor is powered by a cable 37 connected to a cablewinder 70 which carries a coil of windable cable 70' ending in a plug 77. The motor 30 has a driven shaft 32 projecting from each end of the motor 30. A pulley 33 is fixed to one end of the shaft while a frontal clutch 33' is fixed to the other end. The frontal clutch 33' faces and is coaxial with a complementary clutch 33'' fixed to the inner end of a pin 34, which can be slid through a wall 18 of a cover 19 which in turn is fixed by means of screws or the like (not shown) to the column 12 of the frame 1. A hand-wheel 34' is secured to the outer end of the pin 34. A compression spring 34'' is mounted around the pin 34 between the wall 18 and the wheel 34'. Normally, and as shown in FIG. 2, the frontal clutch 33'' is urged away by the spring 34'' and does not engage the frontal teeth of the clutch 33'. However, if desired, the operator can push axially on the hand-wheel 34' in opposition to the spring 34'', and cause the teeth of the clutch 33'' to engage with the teeth of the clutch 33'. Naturally this will be done by the operator only with the motor turned off for the purpose of manually rotating the shaft 32 of the motor, by a few fractions of a turn, or by a few turns, in order to synchronise properly the various members of the machine, as is discussed hereinafter.

The pulley 33 of the motor 30 is connected, via a belt 35, to a pulley 35' of a conventional speed reducer 36 which is mounted on a plate 16 integrally formed with the column 12 of the frame 1. The reducer 36 is of the special type, conventionally known, which rotatably drives a tubular member 36''. The tubular member 36'' secured is keyed to a member 36' to a vertical shaft 38, which is rotatably supported on two bearing supports 16', 16'', secured to the frame 1. The upper end 38' of the shaft 38 is fixed to a conventional elastic clutch 39 which transmits the rotation from the shaft 38 to a shaft 39', in a relatively vibration-less manner, that is to say dampening the load stresses and substantially eliminating the vibrations.

As has previously been said, the electric cable 37 powers the motor 30 via an electrical connection box 40 which contains a standard electrical circuit on the motor 30. However, the motor 30 is activated or coupled to the cable 37 only in the presence of a signal which arrives at the box 40 via the conductor 41 from the device 4 which is discussed later on.

The shaft 39' is journalled in a support 51 and keyed at its top to a coil-carrying plate 52. In the coil-carrying plate 52 there are formed four orthogonal radial slots 52', from each of which there emerges a pillar 53 (FIG. 1) centering the coil 9 of thread to be unwound. Obviously the pillars 53 are each adjusted by a regulatable member, not shown, by means, not shown. Therefore the pillars 53 rotate integrally with the platform 9. Conversely, all around the revolving plate 52 there is a system of supports 60, substantially fixed, for suspending the final portion of thread 90 unwound from the coil 9 to be sent to the user machine, not shown. The supports 60 are four in number and their bearing part 61 has substantially the shape of a square with a horizontal side 71' which is fixed in an adjustable manner relative to the revolving plate 52, via a slot 71". The threading arrangement of the members which effectively support the thread 90 taken from the coil 9 depends on the type of thread 90, that is to say on the material and on the shape and dimensions of its cross section, in addition to the removal speed of the thread 90 and the acceptable wear and tear on the members themselves. In consideration of this, the invention has envisaged various solutions designed to conform the machine to any possible use. Thus the support 60 in the position A (FIG. 1) has an arrangement suitable for threading threads having a round cross sectional shape and made of soft and elastic material and in which the feeding speeds of the plant machines are relatively slow. Thus the support 60 in position A is equipped with the simplest threading members.

The support at position B is equipped with threading members so as to minimize the wear on the horizontal guide member for the thread 90. The support in position C is equipped so as to minimize the wear on the vertical guide member. Naturally the same support can be equipped both with the threading members of position B and with the threading members of position C to minimize the friction and the wear. The support in position D is equipped with a device of the type shown in detail in FIG. 5.

Describing now in detail the members which equip the supports A, B, C and D it is observed that as regards the first three they have in common a horizontal, radial, loop 62A, 62B and 62C pivotally mounted at one end at 62A', 62B', and 62C'. Also in common the supports are equipped with a vertical thread-guide 63A, 63B, 63C, substantially formed by two parallel uprights fulcrumed to the tops 63A', 63B', and 63C' of the supports 60. The lower end 63A", 63B" and 63C" of each vertical thread guide is coupled to one end of a spring 64A, 64B and 64C whose other end is coupled up to one end of a screw 65A, 65B, 65C loosely and horizontally housed in a hole in the supports 60. Two nuts regulate and engage the screws 65A, 65B, 65C for setting the optimum position of the vertical thread-guide. The thread-guide 62B is completed by two longitudinal rollers 162B which are rotably coupled around runners for the horizontal thread-guide 62B. In special cases ball bearings can be mounted between the rollers and the runners of the thread-guide 62B. The thread-guide 63C is completed by two vertical longitudinal rollers 163C.

The thread-guide at position D is shown in FIG. 5. A support 161 is secured to the support 71 and includes a bearing 261 which loosely bears on a pin 261 integral with a guide beam 361 jutting out in cantilever manner from the pin 261'. The beam 361 is formed by two guides 361' and 361" of substantially triangular cross sectional shape between which a thread-guide carriage 461 can longitudinally slide. The carriage 461 has substantially an "H" shaped cross section, and is urged towards the support 161 by a compression spring 561 which abuts at its other end against a plate 661 which joins and acts as a closure for the guides 361' and 361". The surface of the carriage 461 facing the support 161 has a groove 461' in order better to guide the thread. Alternatively a rolling member or bearing can be positioned inside this groove 461'.

In the case where the thread 90 to be unwound from the coil 9 is a ribbon it is expedient to use, in accordance with the present invention, a thread-guide device of the type shown in FIG. 6. This device provides for an adjustable height by means of a support 161 which has a slot 161' through which a screw 161" passes. Four guides 662, 662', 663, 663' jut out horizontally from the support 161, in the centripetal radial direction with respect to the machine. The four guides have substantially an "L" shaped cross section such as to support two sliding seats 664, 665 which carry two coaxial bearings 664' and 665'. A shaft 666 passes through the two bearings 664' and 665' so that a portion of the shaft extends outwardly from each bearing. A spring 667, 667' is coupled to each end of the shaft 666 and at the other end to a support 668, 668' which extends relative to the plate 161, on the opposite side of the thread-guide. At the center of the shaft 666 there is housed a roller 669 mounted on two bearings which is the member which abuts against and guides the ribbon.

Proceeding now to describe the servo control 4 with reference to FIGS. 1 and 2, it is seen that it comprises an eyelet 40' mounted at the top of a rod 41' which, in turn, is screwed to the upper end of a spring 42 whose lower end is screwed on the upper end of a rod 43. The rod 43 is attached at its lower end to a head 44 which is adjustably mounted by means of a screw on a rod 45 which in turn is slidably mounted in a pair of supports 46, 46'. An orthogonal arm 47 is attached to the end of the rod 45 and includes a pin 47' at its own lower end to which there is attached the end of a connecting rod 48 in turn attached at 48' to the end of a lever 48". The other end of the lever 48" actuates a pin 49 that acts on a photosensing system 49' which, through the conductor 41, transmits a signal proportional to the magnitude of the radial displacement of the eyelet 40' to the electronic circuit 40 which controls the motor 30 actuation.

In order to feed the thread 90 unwound from the coil 9 to a machine (not shown one lowers the handle 20 and positions the unwinding machine in position next to the user plant machine. Then, by raising the handle 20, one stabilizes the reel-unwinder in that position. Then by acting on the hand-wheel 34', i.e. by pushing it axially and rotating it the motor shaft 32 can be rotated by small fractions of a turn to rotatably position the platform 52 which carries the coil 90 to center it with the pillars 53. This manual rotation of the plate 52 makes it possible to thread the end of the thread incrementally through the slotted holes 62A, 62B, 40', 62C, 461' and from there into the rollers 152 and 153, thus sending the thread towards the user machine. All the supporting members for the thread and in particular the springs 64A, 64B, 64C and 561 are adjusted so that the thread has to complete the widest possible path. Likewise the eyelet 40' is adjusted so that it supplies the required control signal to the motor box 40 only when the thread 90 reduces the radius of curvature of the thread substantially to the minimum. In other words it is desired to maximize the difference between the arrangement of the diameter of the coil of thread when widest which occurs at the end of each coil and the arrangement of the diameter of the coil of thread when narrowest, which occurs at the start of each coil. Obviously the increase of the coil thread supply decreases the relationship between the number of the interruptions to replace the coil or reel and the number of the drawings of thread on the part of the user machine. The special stabilization of the support members of the thread allows the exploitation of the user machines at maximum levels of production.

When all the members are adjusted as said, one supplies current to the motor 30 from the plug 71 which drives the motor 30 during receipt of the position signal of the eyelet 40' corresponding to a minimum supply of thread 90 available for use; i.e. the eyelet 40' sends the position signal to deactivate the motor 30 when the reel or coil has run out of thread 90.

Having described the invention numerous modifications can be made to its whole without departing from the scope of the present invention.

What is claimed is:

1. A coil unwinder comprising:

a housing;

a platform rotatably mounted to said housing and adapted to carry the coil, motor means carried in said housing for rotatably driving said platform, guide means connected to said housing for guiding one end of the material being unwound from said coil away from said coil, said guide means comprising a vertical support secured to the housing, a pair of spaced and substantially parallel elongated guides secured to the vertical support, said guides extending radially inwardly from the vertical support with respect to the axis of rotation of said platform and defining a horizontal and radial slot between the guides, a carriage slidably mounted between the guides, and spring means for urging said carriage radially outwardly in said slot to abut a thread positioned through said slot, and transport means carried within said housing for laterally transporting said coil unwinder.

2. An apparatus defined in claim 1 in which said transport means comprises at least one triad of wheels, one or more of which are auto-orientatable and means for vertically moving said wheels between a first and second position, wherein in said first position said wheels engage the ground with said housing elevated while in said second position said wheels are retracted within said housing.

3. The invention as defined in claim 2, and in which said last mentioned means comprises a lever means coupled between said wheels and said housing, and a handle for manually actuating said lever means.

4. An apparatus as defined in claim 1, and including means for manually rotating said motor means accessible exteriorly of said housing.

* * * * *